US009108238B2

(12) United States Patent
Bryant

(10) Patent No.: US 9,108,238 B2
(45) Date of Patent: Aug. 18, 2015

(54) PORTABLE SHEET METAL BENDING BRAKE BAR FOR FORMING ANGLES AND CROSS BREAKS IN SHEET METAL

(76) Inventor: Steve R. Bryant, Louisville, KY (US)

( * ) Notice: Subject to any disclaimer, the term of this patent is extended or adjusted under 35 U.S.C. 154(b) by 557 days.

(21) Appl. No.: 13/506,879

(22) Filed: May 22, 2012

(65) Prior Publication Data

US 2013/0312476 A1 Nov. 28, 2013

(51) Int. Cl.
*B21D 5/04* (2006.01)
*B21D 11/20* (2006.01)

(52) U.S. Cl.
CPC . *B21D 5/04* (2013.01); *B21D 11/20* (2013.01)

(58) Field of Classification Search
CPC ..... B21D 5/04; B21D 5/00; B21D 5/002; B21D 5/047; B21D 1/145; B21D 11/00; B21D 11/20; B21D 17/00; B21D 5/042; B21D 49/00; B21D 19/00; B21D 19/08; B21B 5/145; B21B 5/16; B21B 5/163; B25G 1/00
USPC ..... 72/293, 310, 308, 319, 316, 458, 457, 72/460, 461, 379.2, 479, 459, 481.1, 72/482.2, 482.4, 481.6, 409.01, 386–387
See application file for complete search history.

(56) References Cited

U.S. PATENT DOCUMENTS

| | | | | |
|---|---|---|---|---|
| 927,653 | A | 7/1909 | Heckman | |
| 1,324,693 | A | 12/1919 | Rush | |
| 1,344,533 | A | 6/1920 | Cole | |
| 1,344,562 | A | 6/1920 | Probasco | |
| 1,879,583 | A | 9/1932 | Stowell | |
| D173,830 | S | 1/1955 | Bergman | |
| 3,135,312 | A | 6/1964 | Bender | |
| 3,808,873 | A * | 5/1974 | Santhony | 72/479 |
| 3,902,350 | A | 9/1975 | McManus | |
| 4,191,043 | A | 3/1980 | Schaffer | |
| 4,934,174 | A | 6/1990 | Gronlund et al. | |
| 4,934,175 | A | 6/1990 | Hensler et al. | |
| 5,222,386 | A * | 6/1993 | Jones, Jr. | 72/319 |
| 5,394,729 | A | 3/1995 | Eisenhower | |
| 5,611,237 | A | 3/1997 | Harper | |
| D384,560 | S | 10/1997 | Smekal | |
| 5,819,577 | A | 10/1998 | D'Arcy | |
| 5,836,198 | A | 11/1998 | Guilford | |
| 5,934,138 | A * | 8/1999 | Semien | 72/458 |
| 6,094,960 | A * | 8/2000 | Kane et al. | 72/319 |
| 6,941,788 | B2 * | 9/2005 | Goubaud | 72/319 |
| 7,360,390 | B2 | 4/2008 | Lavalliere | |
| 7,690,239 | B2 | 4/2010 | Griffis | |
| 8,028,560 | B2 | 10/2011 | Badiali | |
| 2003/0145642 | A1 | 8/2003 | Volz et al. | |
| 2009/0049885 | A1 | 2/2009 | Postma | |

* cited by examiner

*Primary Examiner* — Peter DungBa Vo
*Assistant Examiner* — Joshua D Anderson
(74) *Attorney, Agent, or Firm* — Carrithers Law Office, PLLC

(57) ABSTRACT

A tool for bending sheet metal and in particular for making bends along the edges and a bend known as a cross break for duct work. A pair of longitudinal right angle members are spaced apart at each end and welded together forming a gap through which a piece of sheet metal is inserted. A pair of parallel rods are welded one to each one of the coplanar webs and perpendicular to the two right angle members at a selected position. The parallel rods provide a handle which may be squeezed to urge the gap closed and thus clamp and hold the sheet metal tightly between the two right angle members whereby the metal can be gripped and bent at the desired angle forming a crease therein.

13 Claims, 2 Drawing Sheets

PORTABLE SHEET METAL BENDING BRAKE BAR FOR FORMING ANGLES AND CROSS BREAKS IN SHEET METAL

TECHNICAL FIELD

The present invention relates to the field that includes tools called sheet metal brake tools used to make straight and accurately placed bends in a piece of sheet metal.

BACKGROUND OF THE INVENTION

Sheet metal is rolled and formed into thin flat sheets or strips to be cut or formed into selected sized and shaped pieces. One of the fundamental types of material forms used in metalworking, sheet metal can be cut and bent into a variety of different shapes. Countless everyday objects are made of the material. Thicknesses can vary significantly, although extremely thin thicknesses are considered foil or leaf, and pieces thicker than 6 mm (0.25 in) are considered plate. Sheet metal thickness is denoted by gauge, sometimes spelled gage, which indicates a standard thickness before processing. Processing may include polishing or the applying of protective plastics which will decrease or increase a sheets thickness. As the gauge number increases the material's thickness decreases. Galvanized steel is thicker than regular steel because the process of galvanizing bonds a layer of zinc to the steel. The layer's thickness can be controlled. The thicknesses are based off of how many ounces per square foot of the galvanizing material is added to the base steel. For instance, some common gages of sheet metal are as follows:

| | Steel | | Aluminum | | Galvanized Steel | |
|---|---|---|---|---|---|---|
| Gage | Inches | (mm) | Inches | (mm) | Inches | (mm) |
| 3 | .2391 | 6.073 | .2294 | 5.827 | | |
| 4 | .2242 | 5.695 | .2043 | 5.189 | | |
| 5 | .2092 | 5.314 | .1919 | 4.620 | | |
| 6 | .1943 | 4.935 | .1819 | 4.115 | | |
| 7 | .1793 | 4.554 | .1620 | 4.115 | | |
| 8 | .1644 | 4.176 | .1285 | 3.264 | | 4.270 |
| 9 | .1495 | 3.797 | .1144 | 2.906 | .1532 | 3.891 |
| 10 | .1345 | 3.416 | .1019 | 2.588 | .1382 | 3.510 |
| 11 | .1196 | 3.038 | .0907 | 2.304 | .1233 | 3.132 |
| 12 | .1046 | 2.657 | .0808 | 2.052 | .1084 | 2.753 |
| 13 | .0897 | 2.278 | .0720 | 1.829 | .0934 | 2.372 |
| 14 | 1.897 | .083 | .0641 | 1.628 | .0785 | 1.994 |
| 15 | .0673 | 1.709 | .0571 | 1.450 | 0.710 | 1.803 |
| 16 | .0598 | 1.519 | .0508 | 1.290 | .0635 | 1.613 |
| 17 | .0538 | 1.367 | .0453 | 1.151 | .0575 | 1.461 |
| 18 | .0478 | 1.214 | .0403 | 1.024 | .0516 | 1.311 |
| 19 | .0418 | 1.062 | .0359 | .912 | .0456 | 1.158 |
| 20 | .0359 | .912 | .035 | .0320 | .0396 | 1.006 |
| 21 | .0329 | .836 | .032 | .0285 | .0366 | .930 |
| 22 | .0299 | .759 | .0253 | .643 | .0306 | .856 |
| 23 | .0269 | .683 | .0226 | .574 | .0276 | .777 |
| 24 | .0239 | .607 | .0201 | .511 | .0247 | .701 |
| 25 | .0209 | .531 | .0179 | .455 | .0217 | .627 |
| 26 | .0179 | .455 | .0159 | .404 | .0202 | .551 |
| 27 | .0164 | .417 | .0142 | .361 | .0187 | .513 |
| 28 | .0149 | .378 | .0126 | .320 | .0172 | .475 |
| 29 | .0135 | .343 | .0113 | .287 | .0157 | .437 |
| 30 | .0120 | .305 | .0100 | .254 | .0142 | .399 |
| 31 | .0105 | .267 | .0089 | .226 | .0134 | .361 |
| 32 | .0097 | .246 | .0080 | .203 | | .340 |
| 33 | .0090 | .229 | .0071 | .180 | | |
| 34 | .0082 | .208 | .0063 | .160 | | |
| 35 | .0075 | .191 | .0056 | .140 | | |
| 36 | .0067 | .170 | .0050 | .127 | | |

One common use of sheet metal is the forming of air handling duct work which is used in most commercial and residential buildings and houses. Some of the duct work is prefabricated and delivered to the construction site. However, it is commonly necessary to fabricate at least some parts of the needed duct work on site. Installation workers on a job site are supplied with flat pieces of sheet metal and are required to cut and bend these pieces to the proper shape and size to be joined with other parts of the air handling structure. A tool which is used to help make straight and accurately placed bends in a piece of sheet metal is known as a 'metal brake' or simply a 'brake'. A conventional brake typically has two jaws with adjacent straight edges which can be urged together to grasp a piece of sheet metal at a selected position whereupon, a third jaw is caused to swing down against a free portion of the metal piece near the edge of the first two jaws and bend the piece of metal to a desired angle. Brakes of this type are often large enough to bend a piece of sheet metal which is up to ten feet long. Therefore, this type of brake is either self standing with integral legs or is mounted on a worktable or bench and is large, heavy and cumbersome to move from one construction site to another.

A cross break is a term used to describe a piece of sheet metal subjected to multiple obtuse bend angles of a selected angle, for example, approximately 170° are made across a flat section of thin metal. Cross breaks formed in square or rectangular sheets are most commonly formed in an X pattern or shape wherein formation of the cross bends or creases create a central bulge defining a slight pyramid shape in the metal without overly distorting it. The crossing ridges forming the cross break stiffens the face of the metal and help prevent is from flexing and buckling under a load which would result in vibration or rattling of an end sheet without a cross break when the heating or cooling fan used in a HVAC system would start or stop. When used correctly this bending method offers a very cost effective way of strengthening your parts. Cross breaks are often incorporated on machine enclosures and duct work where the added rigidity reduces noise from vibration or air flow.

The main advantage of the cross break used to strengthen duct work is that it allows designers to use thinner gauges, thus saving money, and providing a more workable material for fabrication of custom vent components without compromising the strength of the part. Cross breaks do not need to be an X shape to strengthen a part and the brake of the instant invention can be used to create diagonal shapes, triangular shapes or straight angled edges such as flanges as well. Because the cross break can be used in applications where it is difficult to utilize a separate brace it can be used in place of light bracing for a variety of applications. The invention provides a single portable hand held braking tool to form cross breaks formed along bent faces and in single lines to stiffen shaped duct work in order that duct work requiring a custom sheet metal part can be fabricated on site, instantly.

It can be difficult to properly form a cross break with conventional metal bending tools because the bend extends diagonal to the straight edge of the part. For this reason, the bend lines are marked on the metal to be treated either by scoring or simply marking it with a marker or pencil. The sheet of metal is placed in the groove or gap between the spaced apart longitudinal brake members or bars and the break line aligned with the brake edge of the brake. The brake bars are squeezed together to firmly hold the metal therebetween and one hand is used to bend the sheet of metal slightly forming a shallow bend at an obtuse angle along the edge of the bar. The sheet is removed and rotated and placed back between the bars which is a slightly tighter fit in view of placement and alignment of the sheet having a diagonal bend therein between the longitudinal brake members at a selected angle. The braking process is repeated to form a cross break in the metal sheet.

DESCRIPTION OF THE RELATED ART

U.S. Pat. No. 4,934,175 by Hensler et al for TOOL FOR BENDING SHEET METAL AND METHOD THEREOF which issued on Jun. 19, 1990 teaches a sheet metal bending tool having two longitudinal right angle members connected to one another such that, two webs are coplanar to one another and the other two webs are held parallel and adjacent to one another and spaced apart to form a gap. A piece of sheet metal is inserted to a selected position within the gap. The tool is then twisted to bend the piece of sheet metal to a desired angle. A lever is inserted in a hole near the end of one of the coplanar webs to provide leverage for twisting the tool with respect to the sheet metal. Hensler is silent with respect to a means to urge the gap closed tightly against the sheet metal to hold the metal piece in place while bending. The width of the gap in Hensler's tool is fixed and, therefore, when the piece of sheet metal is placed within the gap, a user must hold the sheet metal in place while bending. The gap in the tool of the present invention is urged closed to firmly hold the piece of sheet metal in place while bending.

US Patent Application No. 20030145642 by Volz et al for PORTABLE SHEET METAL BENDING APPARATUS published on Aug. 7, 2003 teaches a frame with four legs, a fixed longitudinal member with a rod of circular cross-section for imparting a curved bend, and a hingedly connected longitudinal member with a lever for bending a piece of sheet metal at the edge. Volz enables the curling of a longitudinal edge of a sheet metal piece but will not allow the insertion and bending of a piece across the center point of that piece.

SUMMARY OF THE INVENTION

In accordance with the present invention, there is provided a metal brake comprising, consisting essentially of, or consisting of a first longitudinal angle member defining a "bar", and a second longitudinal angle member defining a "bar". Although the brake members can be composed of material other than iron, a common name for a steel or iron angular longitudinal member is known in the art as "angle iron". The first angle member includes a first horizontal longitudinal web member extending from and rigidly connected to a top longitudinal edge of a first vertical web member. The second angle member includes a second horizontal longitudinal web member extending from and rigidly connected to a top longitudinal edge of a second vertical web member. The first and the second horizontal web members of the first and the second angle members are coplanar to one another. The two vertical web members are held parallel to one another by a first weld joint at a first free end of the vertical horizontal web members and a second weld joint at an opposite free end of the vertical horizontal web members. The first and the second vertical web members are spaced apart from one another forming an equidistance gap between them. The gap can be about one eighth of an inch wide based on using web members of about 1 inch in width. The gap can be about 3/16 inch wide when using web members having width of about 1 and ¼ inches and the gap can be up to about ¼ inch wide when using web members having a width of about 2 inches. The gap width is critical in that it must be wide enough to insert a sheet of metal having a partial break, but be narrow enough to grip and secure the sheet of material during the braking process. The gap extends along the entire length and width of the interface between the two vertical web members. The first and the second end welds bridge the gap between the parallel edges of the free ends of the vertical web members and connect the free ends of the vertical web members. Means comprising at least one pair of handles comprises a first and second rod extending perpendicularly upward from a top outer or exterior surface of the first and second horizontal web member across from and in alignment with one another are is located about one fourth of the way from the first weld joint. The first rod is centered with respect to the width of the first horizontal web member. The second rod extending perpendicularly upward from a top surface of the second horizontal web member which is located about one fourth of the way from the first weld joint. The second rod is centered with respect to the width of the second horizontal web member so that it is possible to squeeze the first and second rod handle members together with one hand. The first rod and the second rod have a length of about five and one half inches.

It is an object of this invention to provide a sheet metal bending tool which is a hand tool rather than a large, heavy self standing or work bench mounted tool.

It is an object of this invention to provide a sheet metal bending tool which includes a two part handle means for holding the tool wherein the handle also provides leverage for twisting the tool to bend the sheet metal.

It is an object of this invention to provide a sheet metal bending tool wherein the two parts of the handle means are squeezed together to cause two jaws of the tool to clamp and hold the sheet metal in place while bending and thus enable easier accurately placed bends in the piece of sheet metal. The clamping functionality is a major advantage over older art because a user needs to hold the sheet metal piece perfectly still while bending in order to apply the bend in the correct location. The tool of the present invention is capable of fixedly clamping the piece while bending, thus ensuring the piece does not slip and is bent in the proper location.

It is an object of this invention to provide a sheet metal bending tool which includes a ruler or scale adjacent to the position where the sheet metal is held for measuring.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

In accordance with the present invention, there is provided a hand tool, called a metal brake, used to bend sheet metal. The metal brake 10 enables a user to more easily produce accurately placed bends in a piece of sheet metal because sheet metal grasping means are included within the tool.

Figure 1:
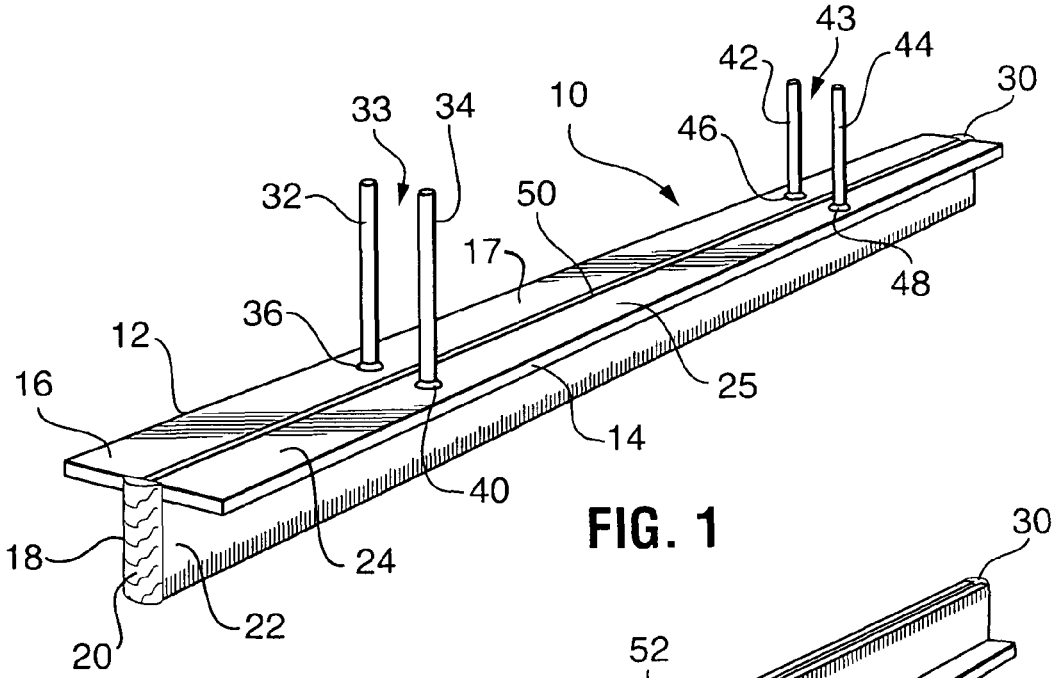
FIG. 1 is a view of the top and left side of the metal brake.
Figure 2:
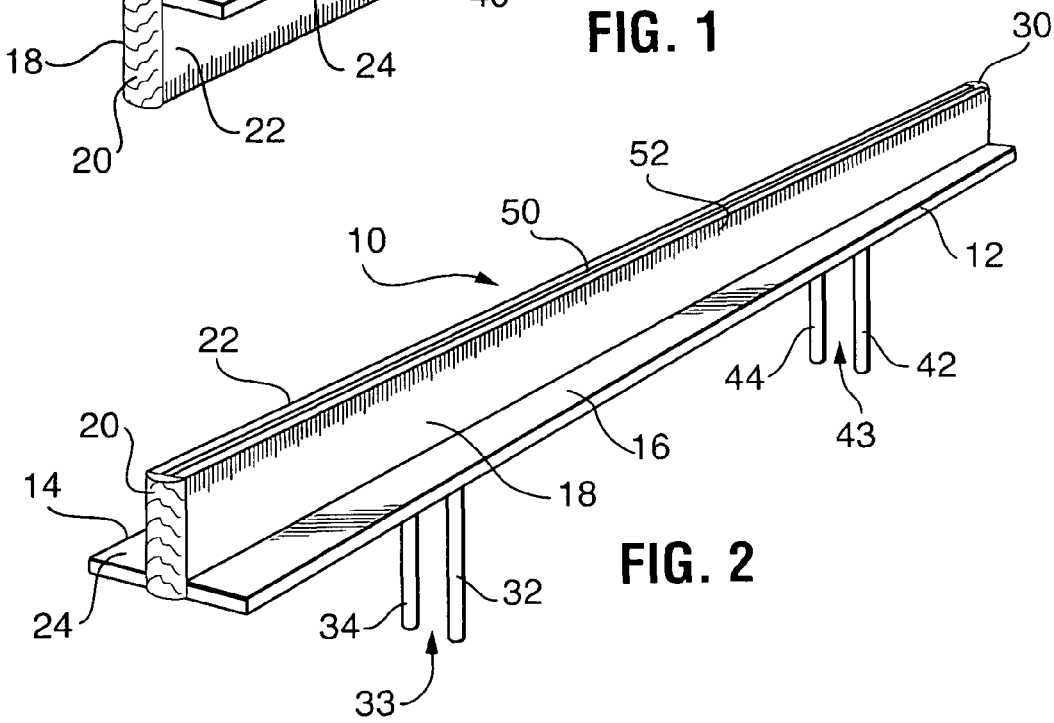
FIG. 2 is a view of the bottom and left side of the metal brake.
Figure 3:
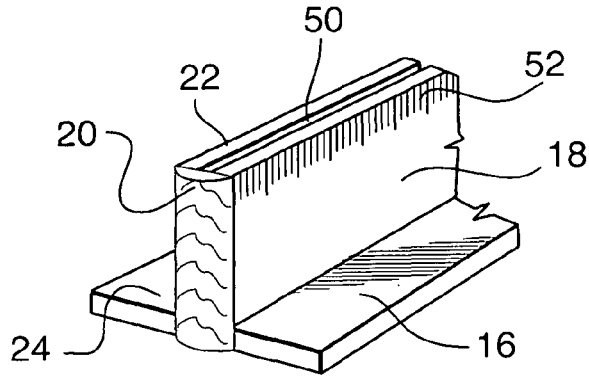
FIG. 3 is view of another embodiment of the present invention including indicia providing a scale for measurement and proper placement of a piece of sheet metal.

Shown in FIGS. 1 and 2, the metal brake 10 includes two angle members 12 and 14, commonly referred to as angle iron, which are joined at extreme ends by welds 20 and 30. Angle member 12 contains two longitudinal web members 16 and 18 which are rigidly connected perpendicular to one another along a selected long free edge of each. Angle member 14 contains two longitudinal web members 22 and 24 which are rigidly connected perpendicular to one another along a selected long free edge of each. Welds 20 and 30 hold the two angle members 12 and 14 together such that web members 16 and 24 are coplanar and web members 18 and 22 are parallel and spaced apart adjacent to one another with a gap 50 being formed between the two. That is, the interface between the two facing surfaces of vertical members 18 and 22 includes a gap 50 or space between the two vertical members. Gap 50 is approximately one eighth of an inch wide when using 1 inch web members, 3/16 inch of an inch gap when using 1 and ¼ inch web members, and up to about ¼ inch wide when using 2 inch web members 5 feet long. Welded joints 20 and 30 bridge the gap 50, at each free distal end of angle members 18 and 22 connecting them together.

Metal brake 10 includes a pair of handles 33 and 43, comprising a pair of rods 32 and 34, and 42, and 44 aligned and spaced apart from one another, each one extending perpendicularly outward from a top surface 17 and 25 of web members 16 and 24 respectively. Rod 32 is located about one fourth of the way from the end of web member 16 which is nearest to weld 20 and is located approximately in the center of the width of web member 16. Weld 36 connects rod 32 to web member 16. Rod 34 is located about one fourth of the way from the end of web member 24 which is nearest to weld 20 and is located approximately in the center of the width of web member 24. Weld 40 connects rod 34 to web member 16. It is an important feature of the present invention that the weld extends from the bottom to the top of the web members 18 and 22 and that the weld attachment points are placed at the distal ends of the web members providing the requisite spring tension between the angle members upon compression of the handles to hold a sheet of material there between.

Metal brake 10 is especially useful for making what is known as a 'cross bend' or "cross break" which is actually two straight diagonal bends that intersect and cross one another at the center of a piece of sheet metal. A cross break is a term used to describe a piece of sheet metal subjected to multiple obtuse bend angles of a selected angle, for example, approximately 170° are made across a flat section thin metal. Cross breaks formed in square or rectangular sheets are most commonly formed in an X pattern or shape wherein formation of the cross bends or creases create a central bulge defining a slight pyramid shape in the metal without overly distorting it. The crossing ridges forming the cross break stiffens the face of the metal and help prevent it from flexing and buckling under a load which would result in vibration or rattling of an end sheet without a cross break when the heating or cooling fan used in a HVAC system would start or stop. This cross break strengthens the piece of sheet metal against bowing in and out in the middle and producing noise when pressure is applied perpendicular to the center of the sheet such as when the fan starts or stops.

In one preferred embodiment, gap 50 is preferably one eighth of an inch wide because a thinner width would cause difficulty when inserting a sheet which had been bent once and is ready to have the cross break applied. A gap which is larger than one eighth of an inch would have reduced clamping capability when squeezing the two handle portions 32 and 34 together.

Figure 4:
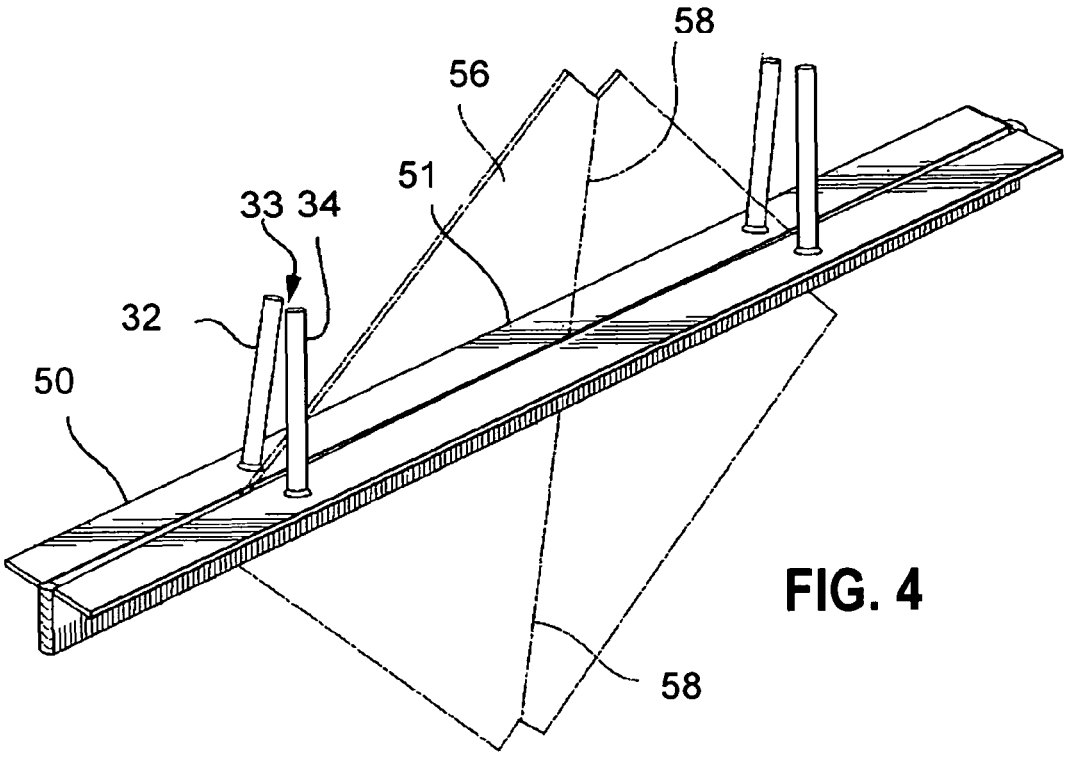
FIG. 4 is a partial view of one end of the metal brake more clearly showing the weld and gap. With a piece of sheet metal inserted in the gap of the metal brake, wherein the metal brake handle is squeezed together securely holding the sheet metal therein.
Figure 5:
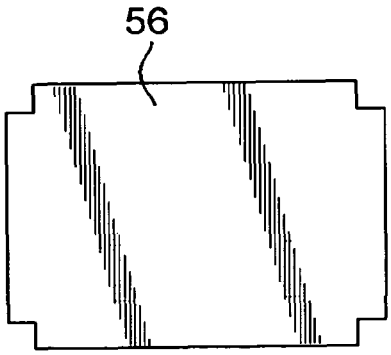
FIG. 5 shows a piece of sheet metal before it is inserted into the brake.
Figure 6:
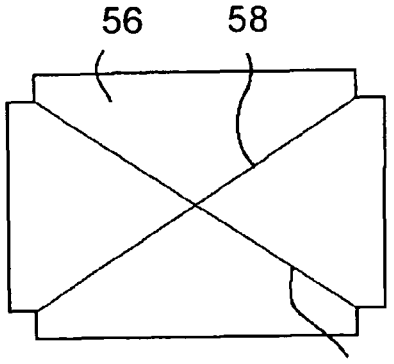
FIG. 6 shows the bends after the sheet metal has been processed (bent) by the brake.
Figure 7:
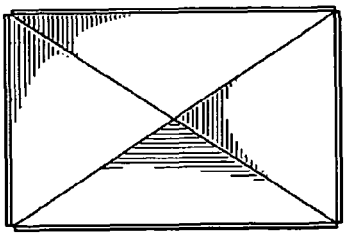
FIG. 7 shows a top view of the sheet metal the edge bent up.
Figure 8:
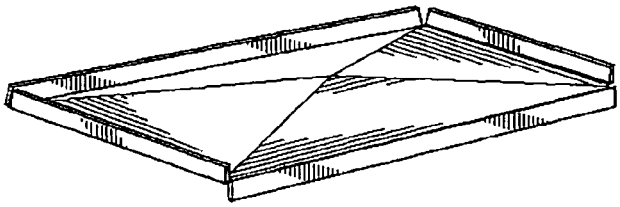
FIG. 8 shows a side view which includes a cross break and a straight edge break forming a metal flange.

As illustrated in FIG. 4, a piece of sheet metal 56 is inserted in the gap 50 of the metal brake 10. One bend 58 has previously been made and the metal piece has been repositioned to make a second bend to complete the 'cross break'.

As shown in FIG. 4, when handle members 32 and 34 are urged toward each other, the gap 50 is partially closed along the central portion 51 of the length of gap 50.

A preferred embodiment of the metal brake has an overall length of about 36 inches long with rods 32 and 34 being placed about nine inches from each distal end of the tool. The width of the web members 16, 18, 22 and 24 is preferably about one inch wide. The rods 32 and 34 are preferably about five to six inches long and may include a rubber or elastomeric coating for grip or be shaped ergonomically for a good grip. It is important that the adjacent rods forming a handle can be gripped with a selected single hand. It is anticipated that a metal brake with a length other than about thirty-six inches may be practical but that for a hand tool, about three feet is considered manageable and comfortably usable.

Another preferred embodiment of the metal brake 10 includes a second handle means 43 comprising two rods 42 and 44 extending perpendicularly outward from the top surfaces 17 and 25 of web members 16 and 24 respectively. Rod 42 is located about one fourth of the way from the end of web member 16 which is nearest to weld 30 and is located approximately in the center of the width of web member 16. Weld 46 connects rod 42 to web member 16. Rod 44 is also located about one fourth of the way from the end of web member 24 which is nearest to weld 30 and is located approximately in the center of the width of web member 24. Weld 48 connects rod 44 to web member 24.

Another preferred embodiment of the metal brake 10 includes indicia 52 which provides a scale for measuring sheet metal and for locating or indicating the proper placement of a piece of sheet metal within the brake 10.

Still another preferred embodiment of the metal brake 10 includes cushioning grips on rods 32, 34, 42 and 44 for comfort and to improve the clamping capability of metal brake 10.

It is anticipated that the metal brake of the present invention is suitable for sheet metal in the range of 24-28 gauge but may be used for gauges in a larger range.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A metal cross brake comprising:

a first longitudinal angle member and a second longitudinal angle member, said first angle member including a first horizontal longitudinal web member extending from and rigidly connected to a top longitudinal edge of a first vertical longitudinal web member, said second angle member including a second horizontal longitudinal web member extending from and rigidly connected to a top longitudinal edge of a second vertical longitudinal web member, said first and said second horizontal longitudinal web members of said first and said second angle members being coplanar to one another, said first vertical longitudinal web members being held spaced apart from and parallel to said second vertical longitudinal web member by a first weld joint at a first free end of said first vertical longitudinal web member and said second vertical longitudinal web member, and a second weld joint at an opposite second free end of said first vertical longitudinal web web member and said second vertical longitudinal web member having a gap formed there between, said gap being a selected width for acceptance of a sheet of metal having at least one cross bend therein, said gap extending along the entire length and width of an interface between said first vertical longitudinal web member and said second vertical longitudinal web member, said first weld and said second weld bridging and connecting said gap between said parallel edges of said first free end and said second free end of said first vertical longitudinal web members and said second vertical longitudinal web member;

at least two pairs of handles spaced apart from one another and disposed at a selected position along said brake, said first pair of handles and said second pair of handles comprising a pair of rods extending perpendicularly upward from a top surface of said first horizontal web member from a top surface of said second horizontal web member respectively in close proximity to one another for gripping simultaneously with a selected hand, and said two pairs of handles are spaced apart from one another in close proximity to be gripped at the same time by a user's two hands;

said first weld and said second weld extending from the bottom to the top of said first vertical longitudinal web member and said second vertical longitudinal web member, said weld joints disposed at the distal ends of said first vertical longitudinal web member and said second vertical longitudinal web member providing an effective amount of spring tension between said first longitudinal angle member and said second longitudinal angle member upon compression of said at least two pairs of handles to hold a sheet of material there between; and wherein said gap is of an effective width to accept and hold a sheet of metal for bending at a selected obtuse angle in a single line forming a bent face, and accepting and holding a sheet of metal having at least one bent line for forming a crease and cross bends therewith at a selected orientation with respect to said bent face, wherein formation of said cross bends create a central bulge including crossing ridges which stiffen a face of said sheet of metal to aid in prevention of flexing, bowing, and buckling of said sheet of metal under a load.

2. The metal cross brake of claim 1 including indicia located on an outward facing surface of said first vertical longitudinal web member, said indicia being located along a bottom edge of said first vertical longitudinal web member, said indicia providing a scale for measurement and proper locating of said sheet of metal within said gap of said metal cross brake for the purpose of applying a bend to said sheet of metal.

3. The metal cross brake of claim 1 wherein a length of said first and said second angle members are thirty-six inches.

4. The metal cross brake of claim 1, wherein said gap is one fourth of an inch.

5. The metal cross brake of claim 1, wherein said gap is three sixteenths of an inch.

6. The metal cross brake of claim 1, wherein said gap is one eighth of an inch.

7. The metal cross break of claim 1, wherein said first pair of handles and said second pair of handles each comprise a pair of rods of a selected length extending perpendicular from the surface of said first horizontal longitudinal web member and said second horizontal longitudinal web member.

8. The metal cross brake of claim 7, wherein said first pair of handles is located one fourth of the way between said first weld and said second weld, and said second pair of handles is located at an opposite end of said metal cross brake one fourth of the way between said first weld and said second weld.

9. The metal cross brake of claim 7, wherein a first rod and a second rod of each of said pairs of rods are centered with respect to a width of said first horizontal web member and said second horizontal web member respectively.

10. The metal cross brake of claim 1, wherein said pair of handles include a coating selected from the group consisting of a rubber, an elastomeric material, and combinations thereof.

11. The metal cross brake of claim 1, wherein said gap being a selected width for acceptance of a sheet of metal having at least one cross bend therein comprises a width of from one eighth to three sixteenths of an inch wide.

12. A metal cross brake consisting of:

a first longitudinal angle member and a second longitudinal angle member, said first angle member including a first horizontal longitudinal web member extending from and rigidly connected to a top longitudinal edge of a first vertical longitudinal web member, said second angle member including a second horizontal longitudinal web member extending from and rigidly connected to a top longitudinal edge of a second vertical longitudinal web member, said first and said second horizontal longitudinal web members of said first and said second angle members being coplanar to one another, said first vertical longitudinal web members being held spaced apart from and parallel to said second vertical longitudinal web member by a first weld joint at a first free end of said first vertical longitudinal web member and said second vertical longitudinal web member, and a second weld joint at an opposite second free end of said first vertical longitudinal web web member and said second vertical longitudinal web member having a gap formed there between, said gap being a selected width for acceptance of a sheet of metal having at least one cross bend therein, said gap extending along the entire length and width of an interface between said first vertical longitudinal web member and said second vertical longitudinal web member, said first weld and said second weld bridging and connecting said gap between said parallel edges of said first free end and said second free end of said first vertical longitudinal web members and said second vertical longitudinal web member;

at least two pairs of handles spaced apart from one another and disposed at a selected position along said brake, said first pair of handles and said second pair of handles comprising a pair of rods extending perpendicularly upward from a top surface of said first horizontal web member from a top surface of said second horizontal web member respectively in close proximity to one another for gripping simultaneously with a selected hand, and said two pairs of handles are spaced apart from one another in close proximity to be gripped at the same time by a user's two hands;

said first weld and said second weld extending from the bottom to the top of said first vertical longitudinal web member and said second vertical longitudinal web member, said weld joints disposed at the distal ends of said first vertical longitudinal web member and said second vertical longitudinal web member providing an effective amount of spring tension between said first longitudinal angle member and said second longitudinal angle member upon compression of said at least two pairs of handles to hold a sheet of material there between; and wherein said gap is of an effective width to accept and hold a sheet of metal for bending at a selected obtuse angle in a single line forming a bent face, and accepting and holding a sheet of metal having at least one bent line for forming a crease and cross bends therewith at a selected orientation with respect to said bent face, wherein formation of said cross bends create a central bulge including crossing ridges which stiffen a face of said sheet of metal to aid in prevention of flexing, bowing, and buckling of said sheet of metal under a load.

13. A metal cross brake consisting of:

a first longitudinal angle member and a second longitudinal angle member, said first angle member including a first horizontal longitudinal web member extending from and rigidly connected to a top longitudinal edge of a first vertical longitudinal web member, said second angle member including a second horizontal longitudinal web member extending from and rigidly connected to a top longitudinal edge of a second vertical longitudinal web member, said first and said second horizontal longitudinal web members of said first and said second angle members being coplanar to one another, said first vertical longitudinal web members being held spaced apart from and parallel to said second vertical longitudinal web member by a first weld joint at a first free end of said first vertical longitudinal web member and said second vertical longitudinal web member, and a second weld joint at an opposite second free end of said first vertical longitudinal web web member and said second vertical longitudinal web member having a gap formed there between, said gap being a selected width of from one eighth to three sixteenths of an inch wide, said gap extending along the entire length and width of an interface between said first vertical longitudinal web member and said second vertical longitudinal web member, said first weld and said second weld bridging and connecting said gap between said parallel edges of said first free end and said second free end of said first vertical longitudinal web members and said second vertical longitudinal web member;

at least two pairs of handles spaced apart from one another and disposed at a selected position along said brake, said first pair of handles and said second pair of handles comprising a pair of rods extending perpendicularly upward from a top surface of said first horizontal web member from a top surface of said second horizontal web member respectively in close proximity to one another for gripping simultaneously with a selected hand, and said two pairs of handles are spaced apart from one another in close proximity to be gripped at the same time by a user's two hands;

said first pair of handle means and said second pair of handle means each one comprise a pair of rods of a selected length extending perpendicular from the surface of said first horizontal longitudinal member and said second horizontal longitudinal member and each pair of handle means;

an outward facing surface selected from the group consisting of said first vertical web member, said second vertical web member, and combinations thereof including indicia located on an outward facing surface, said indicia being located along a bottom edge of said first vertical web member, said indicia providing a scale for measurement and proper locating of a piece of sheet metal within said gap of said metal brake for the purpose of applying a bend to said piece of sheet metal;

said first weld and said second weld extending from the bottom to the top of said first vertical longitudinal web member and said second vertical longitudinal web member, said weld joints disposed at the distal ends of said first vertical longitudinal web member and said second vertical longitudinal web member providing an effective amount of spring tension between said first longitudinal angle member and said second longitudinal angle member upon compression of said at least two pairs of handles to hold a sheet of material there between; and wherein said gap is of an effective width to accept and hold a sheet of metal for bending at a selected obtuse angle in a single line forming a bent face, and accepting and holding a sheet of metal having at least one bent line for forming a crease and cross bends therewith at a selected orientation with respect to said bent face, wherein formation of said cross bends create a central bulge including crossing ridges which stiffen a face of said sheet of metal to aid in prevention of flexing, bowing, and buckling of said sheet of metal under a load.

* * * * *